United States Patent [19]

Murata

[11] 4,146,767

[45] Mar. 27, 1979

[54] PUSH-BUTTON SWITCH

[75] Inventor: Taneo Murata, Tokyo, Japan

[73] Assignee: Alps Electric Co., Ltd., Japan

[21] Appl. No.: 831,896

[22] Filed: Sep. 9, 1977

[30] Foreign Application Priority Data

Sep. 10, 1976 [JP] Japan ..... 51-121808

[51] Int. Cl.[2] ..... H01H 1/06; H01H 3/12

[52] U.S. Cl. ..... 200/159 B; 200/275

[58] Field of Search ..... 200/159 R, 159 A, 159 B, 200/284, 243, 275

[56] References Cited

U.S. PATENT DOCUMENTS

| | | | |
|---|---|---|---|
| 3,178,522 | 4/1965 | Passarelli, Jr. | 200/275 X |
| 3,643,051 | 2/1972 | Foley | 200/275 X |
| 3,808,384 | 4/1974 | Boulanger | 200/275 X |
| 3,870,840 | 4/1975 | Rivetta et al. | 200/275 X |
| 3,917,917 | 11/1975 | Murata | 200/5 A |
| 3,996,429 | 12/1976 | Chu et al. | 200/5 A |
| 4,029,916 | 6/1977 | Chu | 200/5 A |
| 4,056,700 | 11/1977 | Stannek | 200/159 R |
| 4,063,054 | 12/1977 | Hirata | 200/159 R |

*Primary Examiner*—William Price
*Assistant Examiner*—Steven M. Pollard
*Attorney, Agent, or Firm*—Guy W. Shoup; Gerard F. Dunne

[57] ABSTRACT

A push-button switch comprises a push button, a snap-action spring disc, a contact case formed with a recess for containing therein the snap-action spring disc, a common fixed terminal, and two fixed terminals arranged symmetrically in the position lower than that of the common fixed terminal. The contact case is molded with the three fixed terminals integrally incorporated in the contact case such that the respective contact portions of the three fixed terminals are exposed within the recess thereof.

3 Claims, 6 Drawing Figures

PUSH-BUTTON SWITCH

BACKGROUND OF THE INVENTION

The present invention relates to a push-button switch, and more particularly to such a switch which is particularly adapted for use in electronic desk calculators.

At present, electronic desk calculators are introduced in great quantities into the market place and there are needs for durable, inexpensive and highly reliable push-button switches for electronic desk calculators.

SUMMARY OF THE INVENTION

The principal object of the present invention is to provide a push-button switch particularly well suited for use in electronic desk calculators and which is simple and rugged in structure, stable in electrical performance for long periods of time, easy to assemble, and highly reliable.

In accordance with the present invention, there is provided an improved push-button switch well suited for use in electronic desk calculators, which comprises a case formed with a recess for containing therein a snap-action spring disc, a common fixed terminal having two elongate and substantially parallel contact portions spaced apart and supporting the periphery of the snap-action disc within the recess and two fixed terminal portions each have contacts arranged within the recess at a level below that of the contact portions of the common terminal. The case is molded with the three terminals incorporated integrally in the case such that the respective contact portions of the three terminals are exposed within the recess thereof. Preferably, the common terminal is generally H-shaped and has a bridge portion interconnecting the two parallel contact portions and the two fixed terminals are arranged symmetrically on opposite sides of the bridge portion.

BRIEF DESCRIPTION OF THE DRAWINGS

Other objects and advantages of the present invention will become apparent upon reading the following detailed description and upon reference to the accompanying drawings, in which.

DETAILED DESCRIPTION OF THE INVENTION

Figure 4:
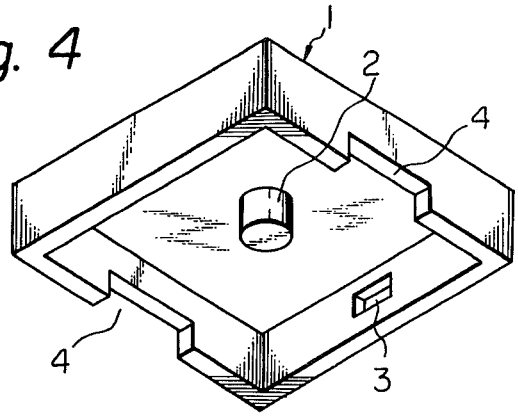
FIG. 4 is a perspective view showing the underside of the push button.

Referring now the drawings wherein like reference numerals have been used throughout to designate like elements, a push-button switch according to the present invention includes a generally square box-shaped push button formed preferably from a synthetic resin or other suitable insulating material and having a cylindrical projection 2 extending downwardly from the center of the rear surface thereof for pushing the peak of a snap-action spring disc 5. The push button 1 is formed in the inner surfaces of its opposing side walls with a pair of recesses 3 (only one of which is shown, see FIG. 4), each recess having a size sufficient for the push button 1 to move with the recesses 3 and 3 held in engagement with projections 9 and 9 provided on opposing surfaces of a contact case 6. The push button 1 is also formed in the other opposing walls with cutouts 4 and 4 for escape of the terminal portions **11*b*, 12*b*, and 13*b* of respective fixed terminals 11, 12, and 13. The snap-action spring disc 5 is formed of a resilient and conductive thin metal plate such as, for example, a pressed stainless steel plate curved to form a part of a spherical surface. The snap-action spring disc 5 serves as a movable contact and as a spring member for returning the push button 1 after it is depressed back to its initial position. The contact case 6 is formed of a synthetic resin or other suitable insulating material and is covered with the push button 1 such that the push button 1 can slide over the outer surface of the contact case 6. The contact case 6 is formed with a circular recess 7 for containing therein the spring disc 5 and the bottom of the recess 7 is formed with a groove 8 in which the contact portions 12*a* and 13*a* of the fixed contacts 12 and 13 are received. The contact case 6 is provided in its opposite side surfaces with a pair of projections 9 and 9 of a triangle cross-section which serve as stoppers to prevent the push button 1** from separating from the contact case.

Figure 6:
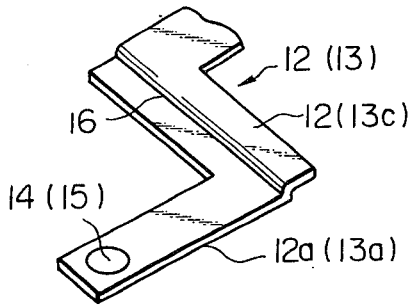
FIG. 6 is a perspective view of a fixed terminal in which its contact portion and connection portion are connected in a stepped fashion.

A common fixed contact 11 as well as the two fixed contacts 12 and 13 are each formed of a conductive material such as phosphor bronze and are incorporated integrally in the contact case 6 when the contact case 6 is molded. The common fixed contact 11 has a substantially H-shape and is composed of two parallel contact portions **11*a* and 11*a* exposed within the recess 7, terminal portions 11*b* and 11*b* extending from the respective contact portions 11*a* and 11*a* in the reverse directions to the outside of the contact case 6, and a bridge portion 11*c* connecting the two contact portions 11*a* and 11*a* at the center of the recess 7. The two fixed terminals 12 and 13 are respectively composed of contact portions 12*a* and 13*a* exposed within the recess 7, terminal portions 12*b* and 13*b* extending from the respective contact portions 12*a* and 13*a* to the outside of the contact case 6, and connection portions 12*c* and 13*c* connecting respectively the contact portions 12*a* and 13*a* and the terminal portions 12*b* and 13*b* in stepped fashion (see FIG. 6). The fixed terminals 12 and 13 are arranged symmetrically on the opposite sides of the bridge portion 11*c* of the common fixed terminal 11 in spaced relation and the contact portions 12*a* and 13*a* are received in the groove 8 formed in the bottom of the recess 7 such that the contact portions 12*a* and 13*a* are placed in a position lower than that of the contact portions 11*a* and 11*a* of the common fixed terminal 11. In this way, the contact portions 12*a* and 13*a* are prevented from coming into contact with the periphery of the snap-action spring disc 5. The portions of the three terminals 11, 12 and 13 other than their portions exposed within the recess 7 and their portions projecting to the outside of the contact case 6, are embedded in the walls of the contact case 6**.

Figure 5:
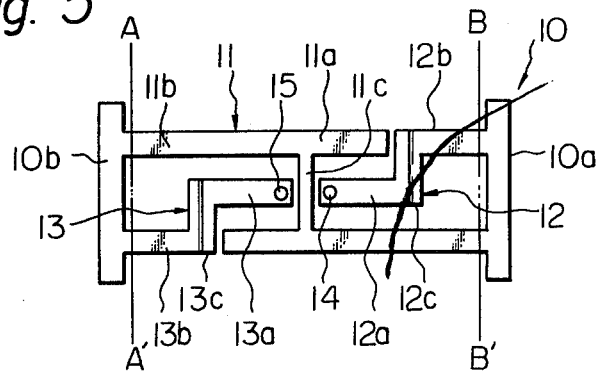
FIG. 5 is a plan view of the contact mother plate.

FIG. 5 shows a mother plate which is stamped from a single length of conductive sheet material so as to have the three fixed terminals 11, 12 and 13 integrally connected by connection bands **10*a* and 10*b*. When the contact case 6 is molded, such a mother plate is incorporated thereinto in order to integrally form the fixed terminals and the contact case 6. Thereafter, the mother plate is cut along the lines A—A′ and B–B′ to remove the connection bands 10***a* and 10*b* so that the three fixed terminals are electrically separated.

The push-button switch of the present invention is assembled as follows: The snap-action spring disc 5 is inserted, with its peak facing upward, into the recess 7 of the contact case 6 formed integrally with the three fixed terminals 11, 12 and 13 in such a manner as described herein. The push button 1 is then attached to the contact case 6 with its recesses 3 and 3 engaged over the projections 9 and 9 formed on opposing surfaces of the contact case 6. In the attachment of the push button 1, the push button 1 may be depressed against the upper inclined surfaces of the projections 9 and 9 to be expanded outwardly so that the projections 9 and 9 can easily be fitted over and held in engagement with the recesses 3 and 3.

Figure 1:
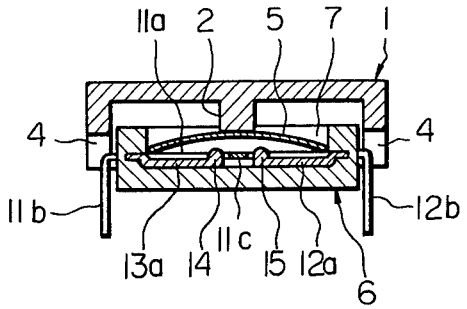
FIG. 1 is a sectional view of a push-button switch in accordance with the present invention.
Figure 2:
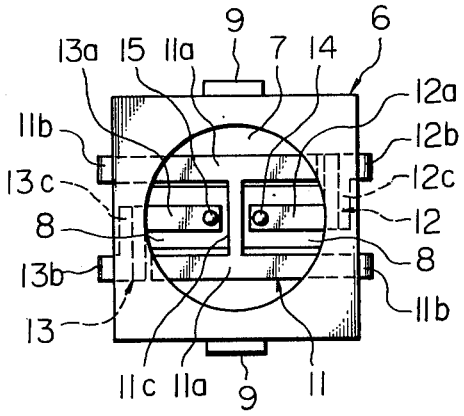
FIG. 2 is a top plan view of the contact case in which the respective fixed terminals are incorporated.
Figure 3:
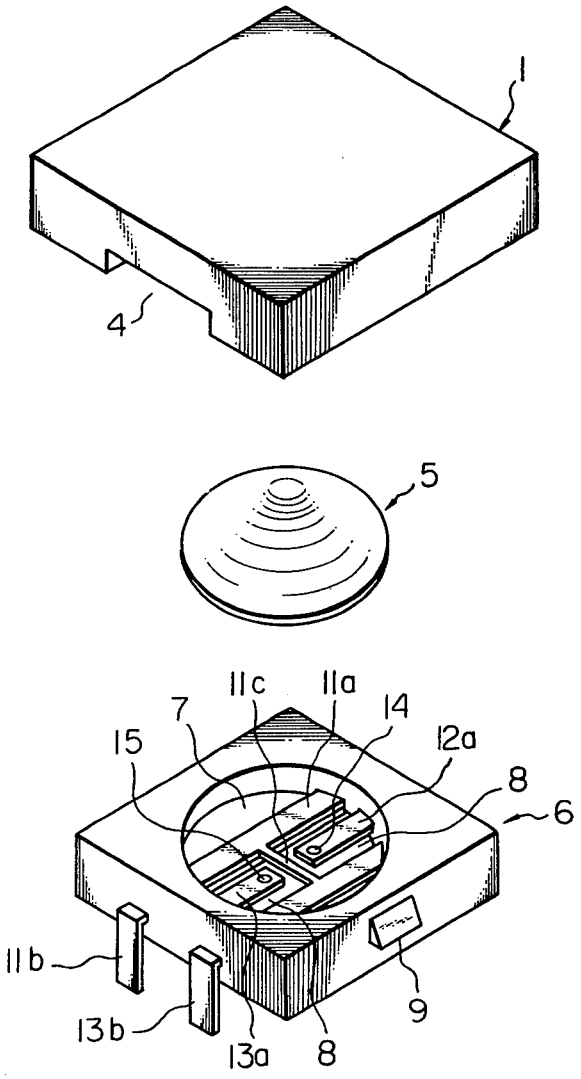
FIG. 3 is an exploded perspective view of the push-button switch.

The operation of the push-button switch of the present invention will be described. In a non-operative state as shown in FIG. 1, the snap-action spring disc 5 has its periphery supported on the contact portions 11*a* and 11*a* of the common fixed contact and its peak upwardly pushing the projection 2 of the push button 1 by its resilient force so as to hold the push-button switch in its OFF state. At this time, the projections 9 and 9 abut on the lower surfaces of the recesses 3 and 3 to stop the push button 1 from moving upwardly.

When the push button 1 is pressed downwardly against the resilient force of the snap-action spring disc 5, the projection 2 thereof pushes the peak of the snap-action spring disc 5 downwards to cause the snap-action of the spring disc 5 so that the lower surface of the spring disc comes into contact with the contacts 14 and 15 on the fixed terminals 12 and 13, thereby changing the push-button switch from the OFF to the ON state.

When the pressure exerted on the push button 1 is released, the resilient force of the spring disc 5 causes its snap-action so that the spring disc 5 snaps back and releases from the contacts 14 and 15 and returns the push button 1 to the initial position, thereby changing the push-button switch into the OFF state.

The push-button switch of the present invention may be provided on a printed circuit base plate by inserting the terminal portions 11*b*, 11*b*, 12*b*, and 12*b* into holes formed in the printed circuit base plate and soldering them to the circuit.

The push-button switch of the present invention, in which the fixed terminals 11, 12 and 13 are formed integrally with the contact case 6, is simple and rugged in structure, easy to assemble, and highly reliable over extended periods of time. In addition, the present invention can eliminate the need for a printed circuit base plate supporting the fixed contacts thereon to thus improve the wear-resistance of the contact portions and provide a stable contact resistance over a long time period.

It is, therefore, apparent that there has been provided, in accordance with this invention, an improved push-button switch high in durability and electrical performance and low in cost that fully satisfies the objects set forth above. While the present invention has been described in connection with a specific embodiment thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. A push-button switch comprising:

a case formed of electrically insulating material and having a recess;

a generally H-shaped common terminal within said recess, said common terminal having two generally parallel, elongate contact portions spaced across said recess from one another and a bridge portion interconnecting said contact portions;

a snap-action spherical spring disk comprised of conductive material and having portions of its periphery supported by said contact portions;

two fixed terminals each having contacts arranged within said recess at a level below that of said contact portions of said common terminal; and a push button operable when pressed to urge said spring disk into electrical contact with the contacts of said two fixed terminals.

2. A push-button switch according to claim 1, said fixed terminals being arranged symmetrically on opposite sides of said bridge portion.

3. A push-button switch according to claim 2, said case being a molding of a resinous material and having said common terminal and said two fixed terminals embedded therein with said respective contact portion and contacts exposed.

* * * * *